US006125555A

United States Patent [19]

Schenkel

[11] Patent Number: 6,125,555

[45] Date of Patent: Oct. 3, 2000

[54] PROCESS FOR ATTACHING A SHOE UPPER TO A SOLE BY APPLYING STAPLES, AND THE RESULTING SHOE

[76] Inventor: Decio Luiz Schenkel, Rua General Emilio Lucio Esteves, 1353, Taquara-RS, Brazil

[21] Appl. No.: 09/243,458

[22] Filed: Feb. 3, 1999

[30] Foreign Application Priority Data

Apr. 2, 1998 [BR] Brazil ..... 9800550

[51] Int. Cl.[7] ..... A43B 23/20

[52] U.S. Cl. ..... 36/12; 36/11.5; 36/23; 12/142 T

[58] Field of Search ..... 36/11.5, 12, 23, 36/14, 21, 17 R, 18, 19 R; 12/142 T

[56] References Cited

U.S. PATENT DOCUMENTS

| | | | |
|---|---|---|---|
| 106,013 | 8/1870 | Wickersham | 36/12 |
| 1,767,748 | 6/1930 | Faleck | 36/12 |
| 1,795,222 | 3/1931 | Lifschutz | 12/142 T |
| 2,068,237 | 1/1937 | Maccarone | 12/142 R |
| 2,252,216 | 8/1941 | Sterzik | 36/11.5 |
| 2,388,744 | 11/1945 | Hoy | 36/11.5 |
| 4,355,473 | 10/1982 | Ilitzky | 36/11.5 |

*Primary Examiner*—M. D. Patterson

[57] ABSTRACT

A process for attaching a shoe upper to a sole by employing staples includes forming apertures near the edge of the sole so that ends of the upper can be inserted into the apertures and attached to the sole by way of staples after the edge of the sole has been displaced. The edges of the sole are preferably adhered to the staples so that the staples remain hidden behind the edges that form the periphery of the shoe sole.

3 Claims, 1 Drawing Sheet

PROCESS FOR ATTACHING A SHOE UPPER TO A SOLE BY APPLYING STAPLES, AND THE RESULTING SHOE

BACKGROUND AND SUMMARY OF THE INVENTION

The present invention relates generally to shoes and, more particularly, to a process for attaching a shoe upper to a sole by applying staples, and the resulting shoe.

A first aspect of the present invention is generally characterized in a process for assembling a shoe having a shoe upper and a sole by inserting portions of the shoe upper into apertures formed in the sole and applying staples to attach the shoe upper to the shoe sole. While the present invention is illustrated as employing staples having a "U"-shaped configuration or form, staples of any design or configuration can be used, provided that they serve the designated function of attaching the shoe upper to the shoe sole. The shoe upper and sole can be manufactured from any appropriate material and are independent from each other; furthermore they are preferably the only parts of the shoe, although other shoe components can be incorporated. It should also be noted that the upper and the sole can each be manufactured from a single independent matrix, as described in a patent application by the same inventor. The staples can be manufactured of metal (e.g., iron, steel, aluminum, etc.), or a plastic material, or any other material which is appropriate to the attaching function (i.e., to affix the shoe upper to the sole). Generally, the free ends or edges of the upper are inserted into the apertures formed in the sole, after which the step of attaching the upper to the sole is carried out. The apertures are formed near the sole edges or ribs, and the sole edges are flexible enough to be displaced before the staples are applied through the parts of the upper inserted into the sole. After applying the staples, the sole edges are allowed to return to their original position and secured with glue to the shoe sole.

A second aspect of the present invention is generally characterized in a shoe fabricated in accordance with the above process.

The invention will be better understood by way of the drawings enclosed, represented by figures briefly described as follows, when examined along with following description.

DESCRIPTION OF THE PREFERRED EMBODIMENTS

Figure 1:
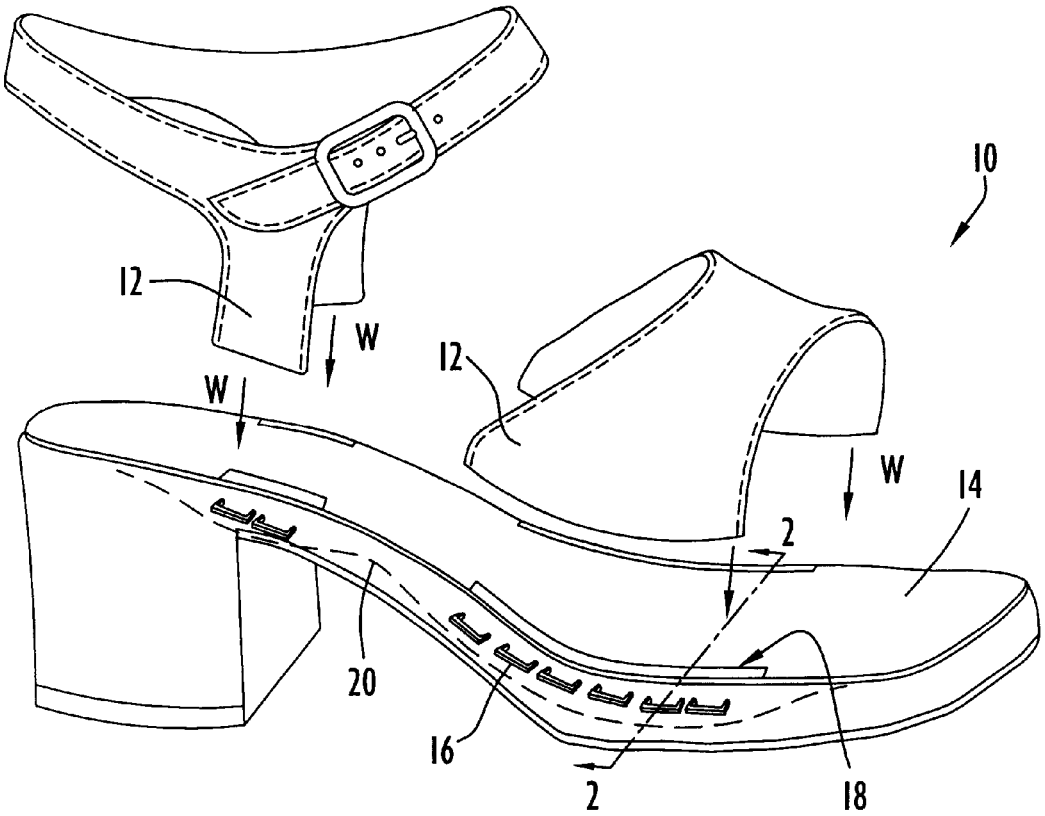
FIG. 1 is an exploded perspective view of a shoe according to the present invention, showing upper and sole spaced apart.
Figure 2:
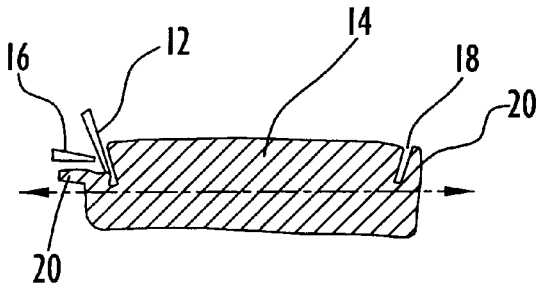
FIG. 2 is a cross sectional view of the shoe shown in FIG. 1, taken through line 2—2, showing details of the shoe construction process.

A shoe 10 constructed in accordance with the present invention, as illustrated in FIG. 1, includes an upper 12 attached to a sole 14 by staples 16. Upper 12 is shown formed of two parts having free ends or edges aligned with apertures 18 formed in the sole 14. Apertures 18 are shown as elongate slots or recesses formed near the periphery or edge 20 of the sole 14 to receive the free ends of the upper 12 when the free ends are moved in the general direction of the arrows W in FIG. 1. The edges 20 are flexible so that they can be peeled back or displaced, as shown by broken lines in FIG. 1, to expose the free ends of the upper 12 such that the free ends of the upper can be attached to the sole 14 with staples 16. After the free ends of the upper 12 have been fixed to the sole 14 by staples 16, the displaced edges 20 are allowed to return to their original, rest positions about the periphery of the sole, preferably with an adhesive or glue having been previously applied in the aperture 18 and/or along the inner face of the edge 20 as a final finishing step. If glue is applied to the staples 16 and/or the inner face of the edge 20, pressure may be applied to the outer face of the edge to facilitate adherence of the edge over the staples. Looking at the left side of the sole section in FIG. 2, an edge 20 is shown being displaced from the sole 14 so that a staple 16 can be applied through a free end of the upper 12 into the sole 14. On the right side of the sectional view in FIG. 2, an aperture 18 is shown in an empty state or condition (ready to receive a free end of the upper), with the corresponding edge 20 being shown in a rest position before being displaced to receive the free end of the upper.

While the present invention has been illustrated using a two-part upper shoe as an exemplary embodiment, it will be appreciated that the present invention can be applied to various types of shoes including, but not limited to, shoes having a one-part upper, etc. In accordance with the present invention, apertures 18 are provided or formed in the sole 14 in corresponding relation to the ends of the respective parts of the upper 12, and staples 16 are used to affix the upper ends to the sole. Thus, it is intended that any alterations of this concept that may occur during the shoe manufacturing process, e.g., to fit specific applications, will fall within the inventive concept disclosed in this patent application, and will be protected by the accompanying claims.

Inasmuch as the present invention is subject to many variations, modifications and changes in detail, it is intended that all subject matter discussed above or shown in the accompanying drawings be interpreted as illustrative only and not be taken in a limiting sense.

What is claimed is:

1. A method for manufacturing a shoe having an upper member and a sole member attached thereto with a plurality of fasteners, comprising the steps of:

(a) providing a sole member having a first side opposite a second side and an upper surface opposing a lower surface;

(b) forming a first aperture in said upper surface near said first side of said sole;

(c) forming a second aperture in said upper surface near said second side of said sole opposite and substantially coextensive with said first aperture;

(d) providing an upper member having first and second ends, said first end being dimensioned to fill said first aperture and said second end being dimensioned to fill said second aperture;

(e) said first aperture defining a first flexible edge, said first flexible edge being foldable to a peeled back or displaced position to expose a first aperture side wall;

(f) said second aperture defining a second flexible edge, said second flexible edge being foldable to a peeled back or displaced position to expose a second aperture side wall;

(g) inserting said first end into said first aperture;

(h) peeling said first flexible edge to the displaced position, thereby exposing said first aperture side wall;

(i) driving a fastener through said first upper member proximate said first end and into said first aperture side wall;

(j) forming a third aperture in said upper surface near said first side of said sole;

(k) forming a fourth aperture in said upper surface near said second side of said sole opposite and substantially coextensive with said third aperture;

(l) providing a second upper member having first and second ends, said first end of said second upper member being dimensioned to fill said third aperture and said second end of said second upper member being dimensioned to fill said fourth aperture;

(m) said third aperture defining a third flexible edge, said third flexible edge being foldable to a peeled back or displaced position to expose a third aperture side wall;

(n) said fourth aperture defining a fourth flexible edge, said fourth flexible edge being foldable to a peeled back or displaced position to expose a fourth aperture side wall;

(o) inserting said first end of said second upper member into said third aperture;

(p) peeling said third flexible edge to the displaced position, thereby exposing said third aperture side wall; and (q) driving a fastener through said second upper member proximate said first end of said second upper member and into said third aperture side wall.

2. The method for manufacturing a shoe of claim 1, further comprising the steps of:

(r) inserting said second end of said second upper member into said fourth aperture;

(s) peeling said fourth flexible edge to the displaced position, thereby exposing said fourth aperture side wall; and (t) driving a fastener through said second upper member, proximate said second end of said second upper member, and into said fourth aperture side wall.

3. The method for manufacturing a shoe of claim 2, further comprising the steps of:

(u) releasing said fourth flexible edge, permitting said fourth flexible edge to assume an undisplaced position covering said fastener in said fourth aperture.

* * * * *